United States Patent [19]

Deziel

[11] 4,094,345

[45] June 13, 1978

[54] DISPENSING MACHINE TO PREPARE CUPS WITH A DRY CONTENT

[76] Inventor: Marcel Deziel, 3365 Petit St., St. Hubert, Canada

[21] Appl. No.: 742,257

[22] Filed: Nov. 16, 1976

[51] Int. Cl.[2] ..... B65B 43/42

[52] U.S. Cl. ..... 141/174; 214/6 BA

[58] Field of Search ..... 141/80, 156–162, 141/168, 173, 174, 129, 186; 214/6 BA; 198/422, 648

[56] References Cited

U.S. PATENT DOCUMENTS 2,940,327 6/1960 Gartner ..... 214/6 BA

*Primary Examiner*—Houston S. Bell

[57] ABSTRACT

A machine adapted to put dry ingredients in cups, as for cups ready to add water to make instant coffee, tea, soup, etc., and wherein the empty cups are positively extracted one by one from stacks of empty cups; spouts are actuated by the cups to positively discharge the dry ingredients in the cups, and the cups with the dry content thereof are automatically stacked and vibrated to compactly engage one in another. This machine comprises an empty cup magazine holding stacks of cups arranged in a straight row, a dry ingredient dispensing mechanism having chutes arranged in a row parallel to the row of stacked cups, a mechanism to positively release the cups one by one from the bottom of each stack, cup pushers reciprocatively displaceable to push consecutive rows of empty cups from under the empty cups magazine to under the row of chutes, a catching bar sequentially holding each consecutive row of cups in registry with the chutes, tripping troughs closing the chutes respectively and pivoted by the oncoming row of cups to positively discharge the dry ingredients in the corresponding cups, and a vibrated magazine to stack the cups with dry content thereof, one in another.

8 Claims, 10 Drawing Figures

DISPENSING MACHINE TO PREPARE CUPS WITH A DRY CONTENT

This invention relates to a dispensing machine and, more particularly, to a machine of the type adapted to prepare cups with a dry content therein as for cups ready to add water and thus produce instant coffee, tea, hot chocolate, soup, etc.

It is a general object of the present invention to provide a machine of the above type which is of practical and positive operation and which prepares many cups at a time for fast and inexpensive production.

It is a more specific object of the present invention to provide a machine of the above type wherein empty cups are positively dispensed one by one from each stack of empty cups.

It is another object of the present invention to provide a machine of the above type wherein dry ingredients are positively discharged in the cups to avoid wastage; to ensure consistent quantities from one cup to another; and to maintain the machine clean as long as possible.

It is still another object of the present invention to provide a machine of the above type wherein the cups with the dry content therein are automatically stacked compactly one in another.

The above and other objects and advantages of the present invention will be readily understood with reference to the following detailed description of a preferred embodiment thereof which is illustrated by way of example in the accompanying drawings, in which.

The illustrated dispensing machine is particularly adapted to prepare cups with the necessary dry content to readily prepare coffee, tea, soup or the like by merely adding water in the cup. The illustrated dispensing machine includes a body 1 formed of a rigid metal framework.

Figure 10:
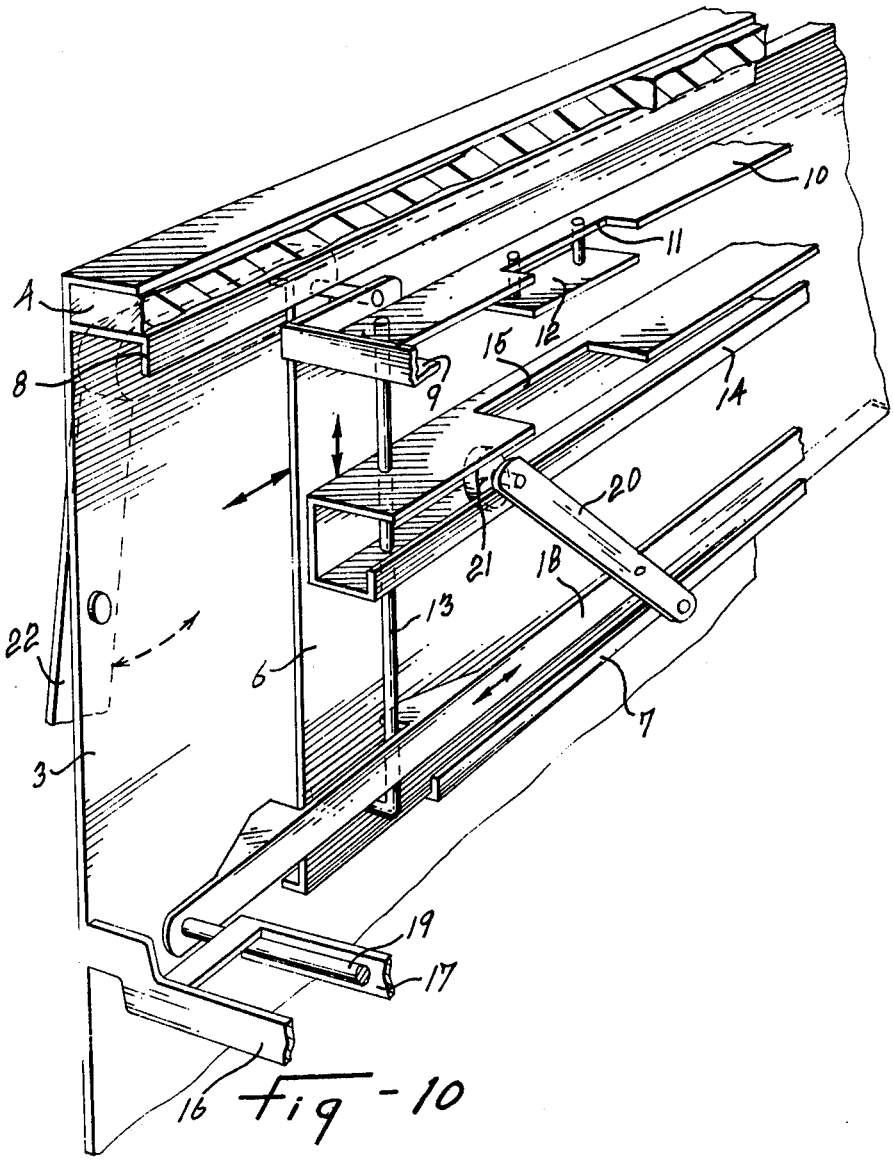
FIG. 10 is a perspective view of one side of the cup-releasing mechanism with the parts in the position of FIG. 7.

A cup magazine 2 is mounted on top of the body 1 and includes a pair of parallel plates 3 laterally spaced apart and inwardly flanged at the top to form a support for a horizontal plate 4. Five tubes 5 are fixed to the plate 4 and extend upright therethrough in a straight transverse row. Each tube 5 forms a magazine cell for a stack of empty cups C. An elongated frame having laterally spaced-apart sides 6 extends between the parallel plates 3 lengthwise longitudinally of the latter and of the straight row of tubes 5. The sides 6 are laterally spaced relative to each other and to the tubes 5 to allow dropping of the empty cups between them. Each side 6 is slidably carried and laterally guided by internal flanges 7 and 8 of the corresponding plate 3, as shown in FIG. 10. The sides 6 are rigidly interconnected by crossbars 9, one of which being shown in part in FIG. 10.

On the inner side and along the upper edge of each side 6, there is fixedly secured a horizontal plate or strip 10 forming a main vertical stop for the bottom cup of each cup stack. A series of five cutouts 11 are formed along the free inner edge of each stopping strip 10 to operatively register with the five-cup stacks. An auxiliary stop plate 12 is fixed to the plate or strip 10 and downwardly spaced from the latter under the cutout 11. Vertical guide rods 13 are fixed to the plate 10 and the side 6 and slidably guide a channel-shaped elongated member 14. Each elongated member 14 is formed with a series of five cutouts 15 spaced apart along the elongated member to register with the cutouts 11 and auxiliary stop plates 12. Each elongated member 14 is thus vertically slidable along the corresponding upright guide rods 13.

The plates 3 are rigidly interconnected by a pair of cross members 16 and 17 which are laterally spaced apart a predetermined distance longitudinally of the plates 3 and row of tubes 5. A rectangular frame including lateral members 18 and transverse rods 19 are displaceable longitudinally of the row of cup stacks and of the plates 3 relative to the latter and to the frame including the sides 6, the plates 10 and the channel member 14. Arms 20 are pivoted to the lateral members 18 and to the sides 6 and carry a guiding roller 21 rolling in one channel member 14. An arm 22 is reciprocatively pivoted against the external face of one lateral plate 3 and is connected to one side 6 at its upper end to reciprocatively displace the latter.

Figure 7:
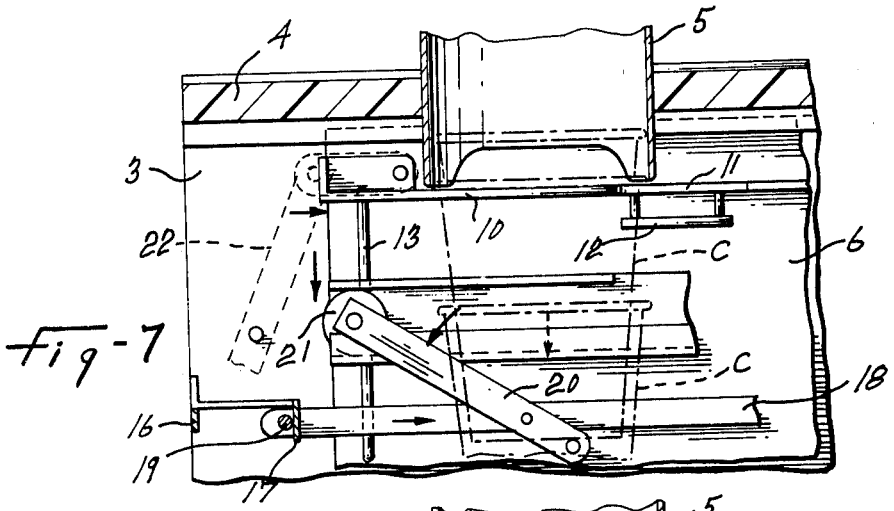
FIG. 7 is a cross-sectional elevation view of FIG. 6 particularly illustrating one side of a cup-releasing mechanism in normal cup stack holding and cup released position.
Figure 8:
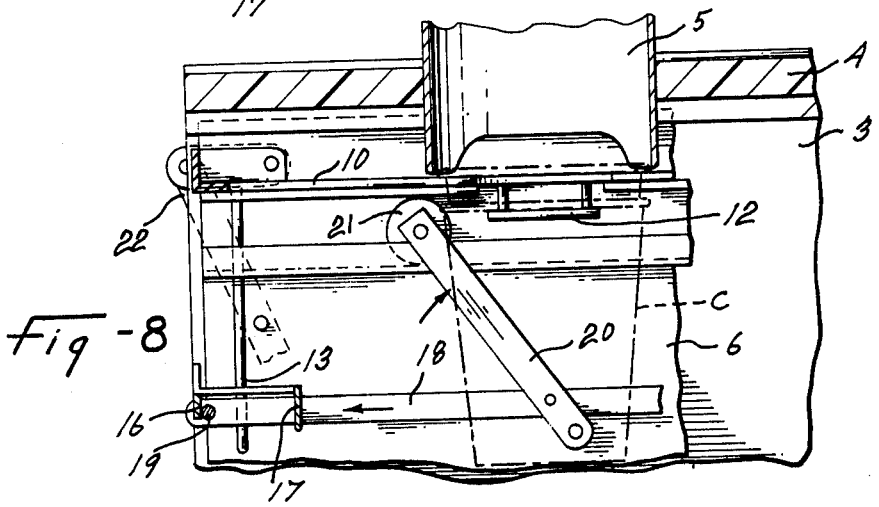
FIG. 8 is similar to FIG. 7 but with the cup releasing mechanism at the start of a cup-releasing operation.
Figure 9:
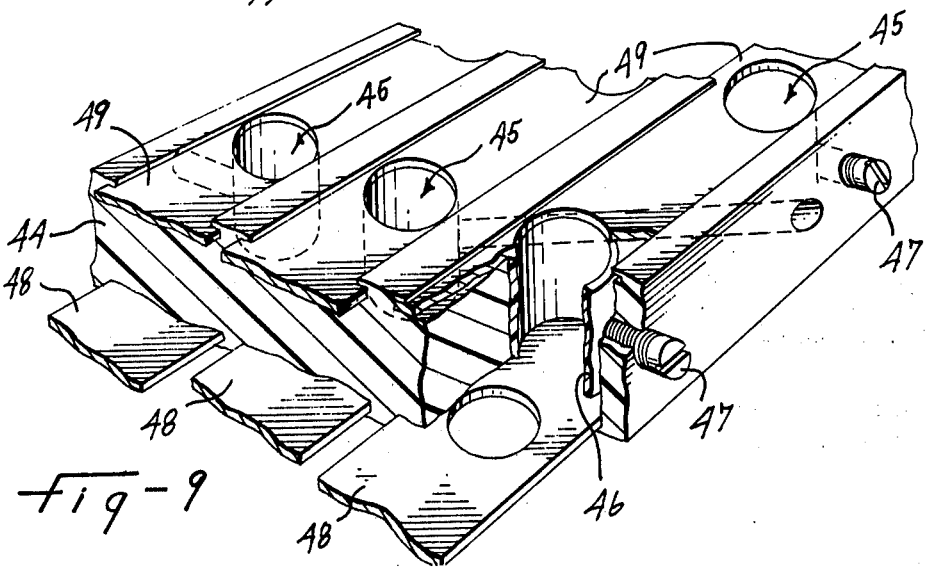
FIG. 9 is a perspective view of a dry ingredients measuring device.

With reference to FIGS. 7, 8, and 10, it may be seen that when the arm 22 is pivoted counterclockwise, the frame including the sides 6 slides leftward together with the lateral members 18 and transverse rods 19. When the latter hits the transverse bar 16, the central pivot of each arm 20 is immobilized but its lower pivot still travels leftward with the sides 6. This causes upward lifting of the cup extraction members 14 toward the bottom cup stop plate 10. When the members 14 engage the stop plates 10 respectively, the top of the members 14 engages the corresponding stop plates with the cutouts 11 and 15 in vertical registry and the auxiliary stop plates 12 underlying the top of the members 14. In such position, the bottom cup C is allowed to drop in the cutouts 11 and 15 and to be held at the rim by the auxiliary stop plates, as may be seen in FIG. 8.

When the arm 22 goes through the reverse stroke, the sides 6, the lateral members 18 and the arms 20 first move bodily until the tranverse rod 19 stops against the transverse member 17. From that point, further rightward displacement of the sides 6 pivots the arms 20 counterclockwise and causes the edge of the channel member 14 to engage the rim of the bottom cup and to positively push the latter downward and allow the cup to drop. In the meantime, the next cup is held by its rim on the edge of the main stop plate 10, as shown in FIG. 7. It must be noted that the linkage defined by the arms 20 and the lateral members 18 and rods 19 produces a lost motion connection between the sides 6 and the cup extraction members 14.

A panel 23 is rigidly fixed to the body 1 and forms a slideway for the released cups which slideway extends from underneath the cup magazine 2 to a dry ingredient dispensing station. This slideway defines a released cup path extending transversely of the row of cup stacks. A cup-conveying mechanism is mounted on the body 1 under the cup magazine 2. This cup-conveying mechanism comprises a carriage including a main plate 24 carried by lateral profile members 25 slidable in U-shape channels 26 respectively. A row of five arc-shaped cup pushers 27 are carried by the carriage in an opening 24' of the main plate 24 and extend lengthwise in the same direction as the straight row of tubes 5.

A motor 28 is connected by pulleys 29 and 30 and a belt 31 to drive a crank arm 32. A push rod 33 is rotatably connected on the outer end of the crank arm and to the cup-conveying carriage whereby reciprocative displacement of the cup pushers 27 is produced by rotation of the motor 28.

The linkage system to actuate the cup-releasing mechanism 2 includes a push arm 34 connected at its ends to the actuation arm 22 and to a pivoted arm 35 pivotally connected to the body 1. A third arm 36 is pivoted at its ends to the plate 24 and to the other end of the arm 35. Thus, when the carriage including the plate 24 reciprocates in one direction defining the path of the released cups, the cup-releasing frame including the sides 6 slides in an orthogonal direction relative to the direction of the cup-conveying carriage.

A cup-catching bar 37 extends transversely of the machine and at the front thereof and is mounted on one end of a pair of push rods 38. The latter are slidably mounted and extend lengthwise along the opposite sides of the body 1. Springs 39 are connected to the cup-catching bar 37 to bias the latter toward cup-catching position. A pair of rocker arms 40 are pivoted to the body 1 at the rear thereof about a transverse axis. These rocker arms 40 are positioned adjacent the opposite sides of the machine with their lower end in operative engagement with the corresponding push rod 38. A pair of upper push rods 41 are slidably mounted and extend lengthwise along the opposite sides of the body 1. These push rods 41 are biased by springs 42 away from the rocker arms 40 to allow rearward displacement of the push rods 38 and of the cup-catching bar 37 to a position for catching and holding the released cups when the latter are pushed to the dry ingredient dispensing station. The upper push rods 41 are positively moved rearward to pivot the rocker arms 40 and forwardly displace the lower push rods 38 and the cup-catching bar 37. This movement is sequentially repeated to release the cups after the dry ingredients have been fed therein.

A dry ingredient dispensing mechanism 43 is mounted on the body 1 over the dry ingredient dispensing station. This dispensing mechansim 43 includes an ingredients measuring base portion supporting a dry ingredient magazine portion.

The dry ingredients measuring portion includes a flat body 44 of plastic or the like, formed with an array of fifteen holes 45 upwardly extending therethrough. These holes are arranged in three rows of five such that the three rows are parallel with the row of cup stacks, and in each row of holes 45, the latter are spaced apart in relation with the spacing of the five cups which arrive at the same time at the dispensing station. A plastic lining 46 lines the periphery of each hole 45 and is removably securable by a set screw 47. A lower and an upper metal strips 48 and 49 slide endwise under and over each row of holes 45 and against the lower and upper faces respectively of the flat plastic body 44. The latter is integrally formed with guideways for the sliding strips 48 and 49.

A linkage system comprising the arms 50, 51, and 52 and the connecting blocks 53 and 54 operatively slides the strips 48 and 49 to selectively register the holes of either strip with the corresponding cylindrical holes 45. When the holes of the upper strips 49 register with the cylindrical holes 45 of the body 44, they also register with the open bottom of the corresponding dry ingredient container or magazine 55 while the holes of the lower strips are out of registry with the cylindrical holes 45. This produces charging of the cylindrical holes with a measured quantity of dry ingredient. When the strips 48 and 49 are displaced to the dispensing position, the strips 49 close the top of the cylindrical holes 45 and the holes in the strips 48 register with the cylindrical holes or cavities in the body 44. Thus, the measured quantities of dry ingredients are allowed to drop in the five funnels or chutes 56. The five funnels 56 are laterally spaced apart to overly the five cups in operative position at the dry ingredient dispensing station.

It must be noted at this point that the number of magazines 55 and of rows of measuring holes or cavities 45 depends on the number of distinct ingredients which are fed in the cups. Certain holes in the strips 48 and 49 might be skipped such that out of the five cups which are prepared at the same time, a first cup could receive only instant coffee, a second cup could receive coffee and sugar; a third cup could receive coffee and milk powder; and the fourth and fifth cups could receive the three ingredients. For example, such first cup would be obtained by skipping the holes in the strips 49 which, for this cup, would otherwise register with the sugar and milk powder magazines. The magazines 55 extend lengthwise longitudinally each over a strip 49 and are continuously replenished by tubes 57, each connected to any appropriate ingredient feeding arrangement, not shown.

Figure 6:
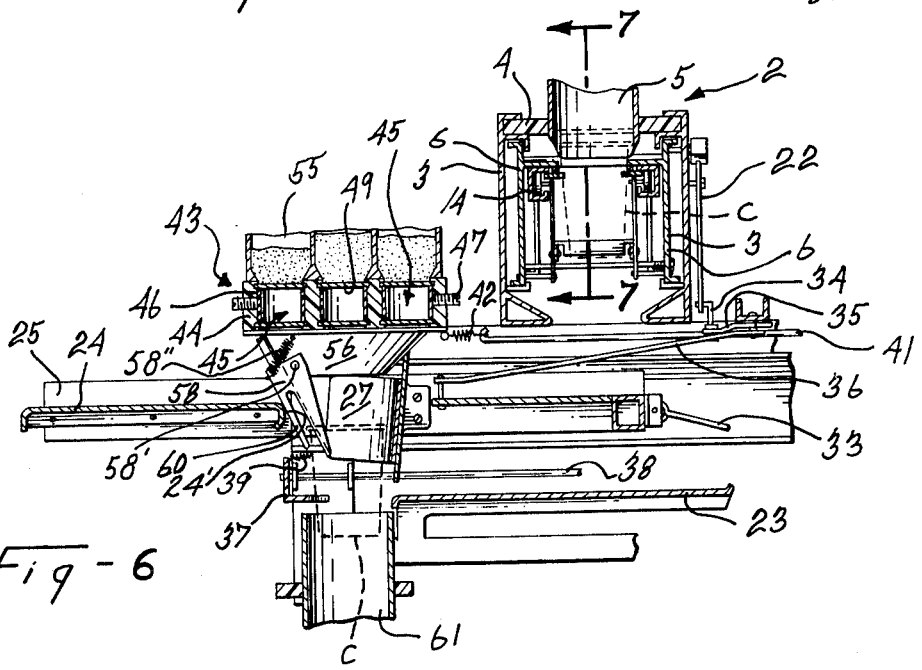
FIG. 6 is an enlarged detailed view of FIG. 5 particularly illustrating the dry ingredient dispensing position.

A tripping trough 58 is pivotally connected to each funnel 56 about a transverse pivot axis 58'. A toggle spring 58" resiliently maintains trough 58 either in a funnel closing position or in a downwardly extending funnel opening and discharging position. Each tripping trough 58 extends lengthwise of the path of one cup arriving at the dispensing station. Each tripping trough has a trough portion 59 and a pair of underlying laterally spaced-apart elongated projections 60. The latter project endwise away from the transverse pivot axis of the trough and in opposite direction relative to the direction of displacement of the cups toward the dispensing station. The discharging trough portion 59 is spaced above the elongated projections 60 to define a slot therebetween. The free end of projections 60 terminates short of the pouring free end of the trough portion 59. When trough 58 is in closed position, projections 60 are in the path of an arriving cup; but trough portion 59 is disposed slightly above said cup. Thus, a cup arriving at the dry ingredient dispensing station engages the projections 60 with the latter straddling the cup under the rim thereof. The displacement of the cup then pushes on the projections 60, thus causing the trough portion 59 to pivot downward into the cup with the cup wall engaging the above-noted slot; spring 58" maintains trough 58 in tilted position. As shown in FIG. 6, when the bar 37 catches the row of five cups, the trough portions 59 are engaged in the corresponding cups. The strips 48 and 49 are simultaneously and progressively actuated, causing the dry ingredients to positively discharge into the troughs and into the cups. Upon return of the carriage and plate 24, abutment edge 24' of the latter abuts projections 60 and pivot trough 58 back to its closed position.

Figure 2:
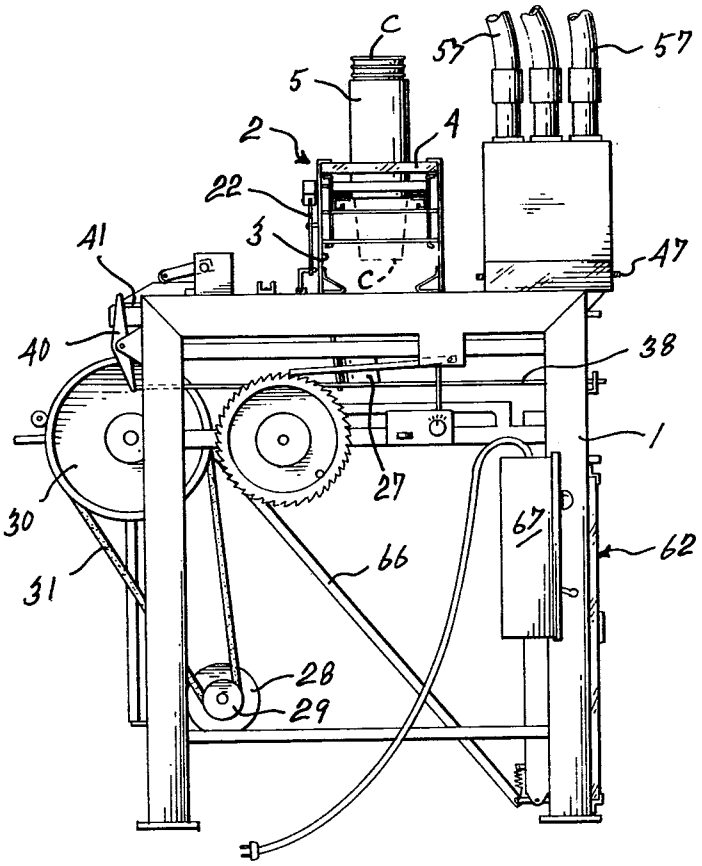
FIG. 2 is a left side elevation view of the dispensing machine of FIG. 1.
Figure 1:
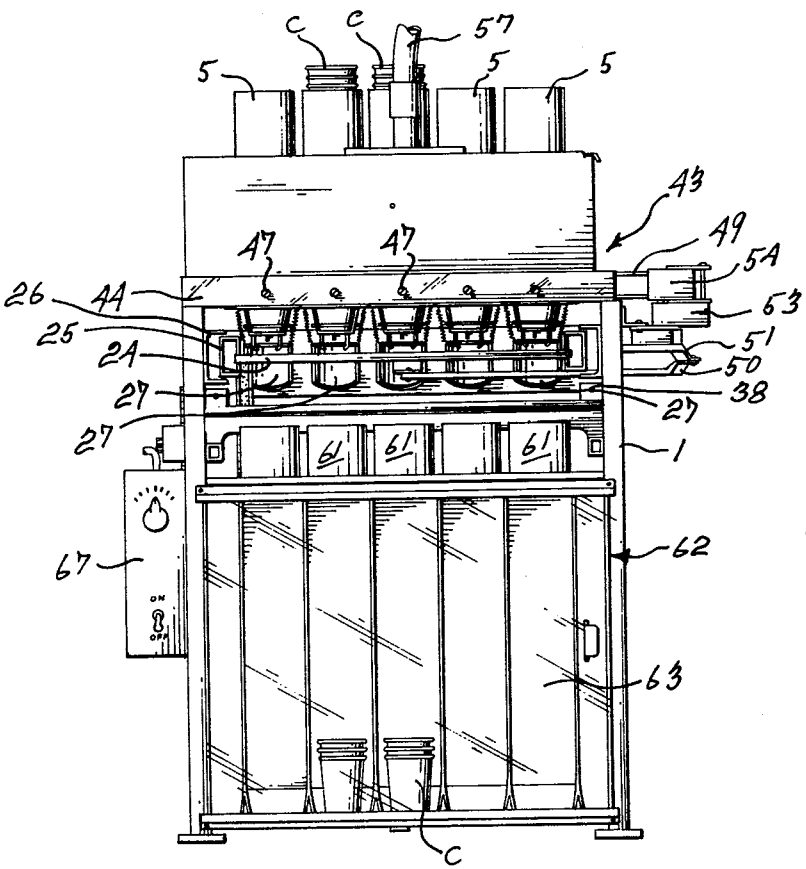
FIG. 1 is a front elevation view of a dispensing machine according to the present invention and adapted to prepare cups with a dry content.
Figure 4:
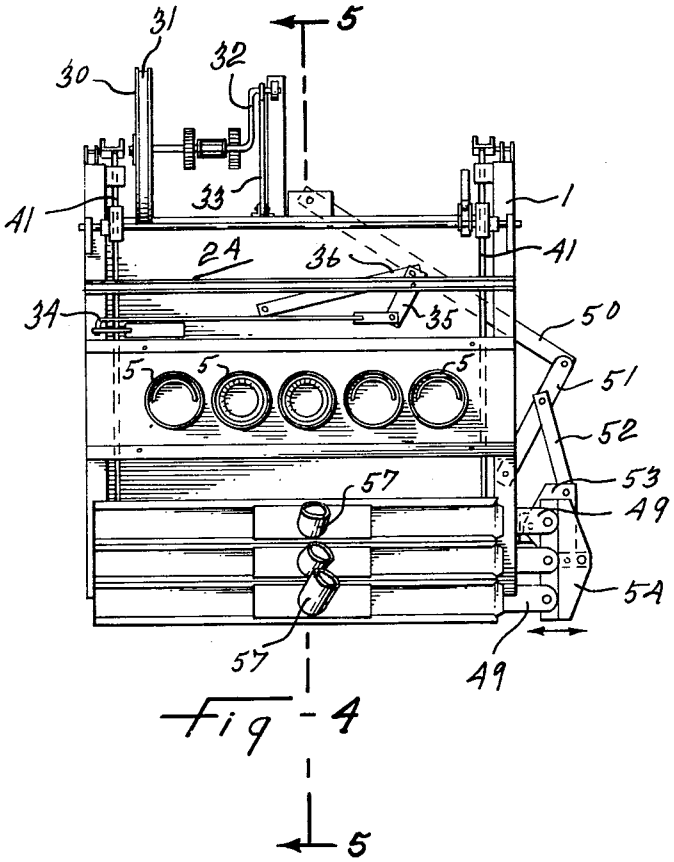
FIG. 4 is a top plan view of the dispensing machine.
Figure 3:
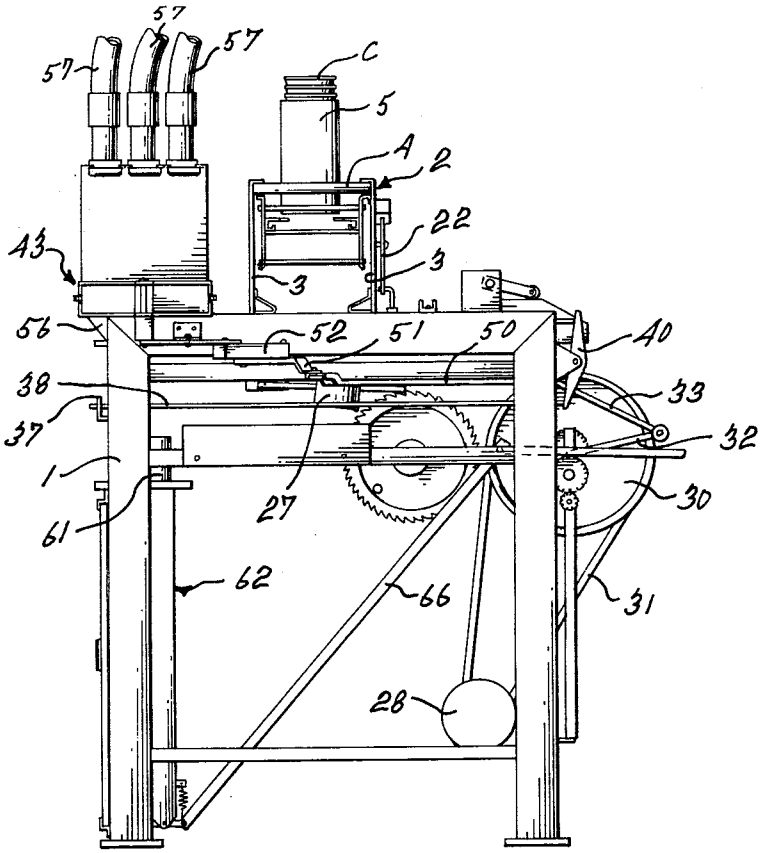
FIG. 3 is a right side elevation view of the dispensing machine.
Figure 5:
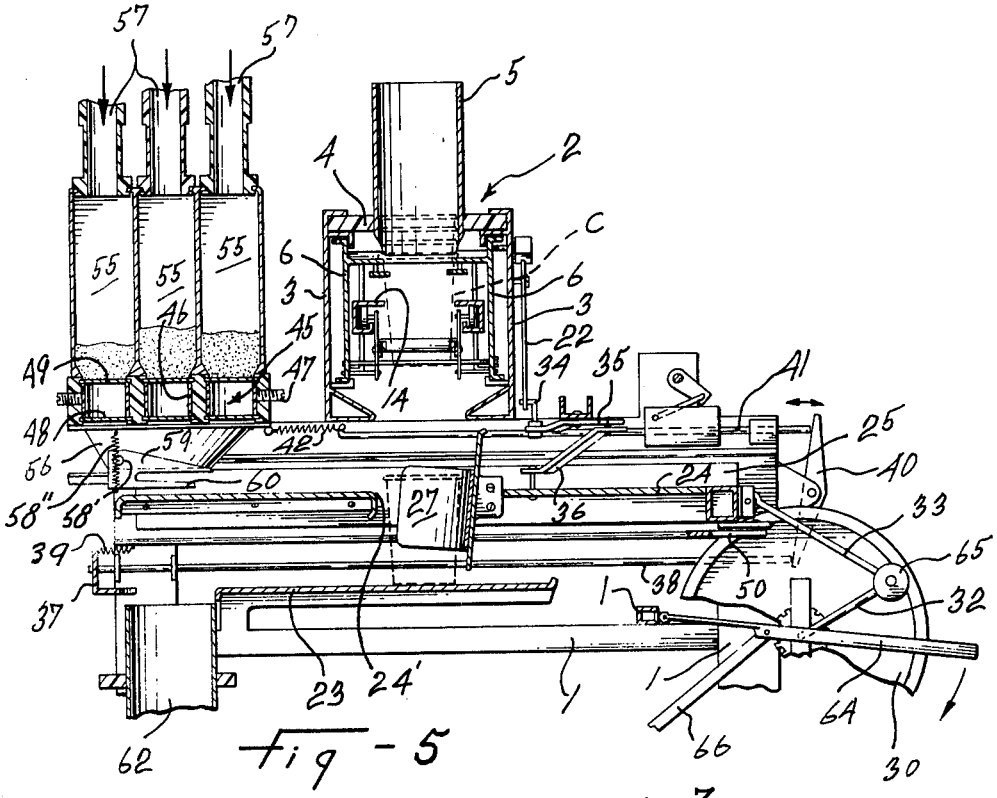
FIG. 5 is a cross-sectional elevation view as seen along line 5—5 in FIG. 4 and with the cup-conveying mechanism in retracted cup-receiving position.

The cups with a dry content are also released by bar 37 to fall and stack in upright tubular cells 61 of a magazine 62. The latter is of rectangular shape and has a transparent front face 63, as may be seen in FIG. 1. This prepared cups magazine is pivotally supported at its upper end for pivotal movement about a transverse axis parallel to the trips 48 and 49 and to the row of cup stacks. An arm 64 is pivoted to the body 1 about a transverse axis and rearwardly projects endwise in the path of an actuating roller 65. The latter, upon rotation of the crank 32, engages the arm 64 and pivotally displaces the same. A push bar 66 is connected at its opposite ends to the arm 64 and to the bottom of the magazine 62 and induces a pivotal vibration of the latter. This vibration causes the cups with the dry content to neatly stack one in another in each cell 61. A supply of prepared cups may be removed from the machine to be sold to any restaurant, canteen, or coin machine service.

An electrical control box 67, of any appropriate type, is connected to the motor 28 and to the other electrical actuators and elements and is adapted to regulate the sequential operation of the various movements.

What I claim is:

1. In a machine to pour a dry granular or powdered ingredient into cups, the combination comprising a frame, an empty cup magazine carried by said frame for supporting a stack of nestled empty cups, a cup-releasing mechansim mounted at the lower end of said empty cup magazine for releasing the bottomost cup of said stack of empty cups, a cup-conveying mechanism mounted on said frame underneath said cup-releasing mechanism for receiving a cup released by said cup-releasing mechanism and conveying said cup along a path to a position at a dry ingredient dispensing station, a dry ingredient dispensing mechanism carried by said frame above and including a funnel having a bottom outlet in register with a cup positioned at said dispensing station, and a tripping elongated trough having a pouring end and pivoted about an axis transverse to the length of said trough and located away from said pouring end, said trough having an elongated projection extending underneath the same and along the same, being connected to said trough away from said pouring end to define a slot between the bottom of said trough and said projection, said projection having a free end disposed short of said pouring end, said trough biased to take a normal position closing said funnel bottom outlet, and having its pouring end disposed just above a cup being conveyed to said ingredient dispensing station and with said projection having its free end in the path of said last-named cup, said last-named cup, during its terminal movement towards said station, abutting against said free end of said projection and causing downward pivoting of said trough to an open discharging position to cause said trough pouring end to engage over and into said cup as said cup reaches said station while uncovering said funnel bottom outlet to allow pouring of the ingredient from said funnel into said cup, the top portion of the cup wall progressively engaging said slot during downward pivoting of said trough.

2. In a machine as defined in claim 1, wherein there is a pair of laterally spaced-apart elongated projections projecting with said trough endwise away from the transverse pivot axis of the trough and in opposite direction relative to the direction of displacement of the cups along said path.

3. In a machine as defined in claim 1, wherein said cup-releasing mechanism includes a main stop device releasably holding the bottomost cup in non-released position, an auxiliary stop device releasably holding the bottomost cup in partially released position, and a movable extractor positively engaging a partially released cup and separating the same from the remainder of the stack.

4. In a machine as defined in claim 3, wherein said main stop device includes a pair of laterally spaced-apart support members engaging the opposite sides respectively of the bottomost cup and holding the same in non-released position, said auxiliary stop device includes a pair of laterally spaced-apart auxiliary support members underlying the main support members respectively and said movable extractor includes a pair of laterally spaced-apart cup extraction members operatively engaging the upper edge of a released cup on opposite sides of the latter and downwardly pushing the same for extraction thereof from the bottom of the stack.

5. In a machine as defined in claim 4, wherein said cup magazine carries said one and other stacks of empty cups with said stacks laterally spaced from each other along a straight row, said cup-releasing mechanism includes an elongated frame having laterally spaced-apart sides extending lengthwise longitudinally of said straight row and each having an upper edge portion constituting one of said support members and having cutout portions spaced along the length thereof for registry with said stacks respectively, each of said sides includes inward projections underlying said cutout portions respectively and constituting auxiliary support members for partially released cups respectively, and said pair of cup extraction members extend each longitudinally along one of said sides and includes inward projections operatively engaging the upper edge of partially released cups and downwardly pushing the same for extraction thereof from the bottom of a stack.

6. In a machine as defined in claim 5, wherein said cup extraction members are slidably connected to said sides respectively for up and down displacement, a first actuation linkage assembly is connected to said elongated frame and longitudinally displaces the latter to and fro lengthwise of said row and a second actuation linkage assembly connects said extraction members to said elongated frame and includes a lost motion connection for sequential up and down displacement of the cup extraction members.

7. In a machine as defined in claim 6, wherein a prepared cup magazine is mounted underneath said dry ingredient dispensing station, is pivoted to said frame about a transverse axis relative to the path of the released cups, and includes open top upright cells for stacking of the prepared cups therein and a vibratory actuation mechanism is connected to the prepared cup magazine and operatively vibrates the same about the transverse pivot axis thereof for compact stacking of the prepared cups upright one in another.

8. In a machine as defined in claim 7, wherein said frame includes a panel forming a slideway for the released cups and extending from underneath the empty cup magazine toward but terminating short of the dry ingredient dispensing station, said cup-conveying mechanism includes a carriage displaceable lengthwise of the path of displacement of the released cups, cup pushers fixed to said carriage and laterally spaced apart along the straight row of stacks and a reciprocative drive connected to said carriage and reciprocatively displacing the latter and the cup pushers to and from between the empty cup magazine and the dry ingredient dispensing station, said first actuation linkage assembly is connected to said carriage and actuated by displacement of the latter, said dry ingredient dispensing mechansim includes a plurality of said funnels arranged in a row extending parallel to the straight row of cup stacks, as many tripping troughs as there are funnels each associated with one funnel a toggle spring arrangement biases each tripping trough into either said closed position and said open discharging position, a cup-holding mechanism is is carried by said frame and includes a cup-catching bar laterally displaceable at the dispensing station and operatively catching a row of cups at the dispensing station in underlying registry with said funnels to retain said cups at the dispensing stations over the open top upright cells, means operated upon movement of said carriage away from said dispensing station to move said cup-catching bar to cup-releasing position to allow falling of the prepared cups into said cells, said carriage further including an abutment engaging said tripping troughs when the latter are in their open discharging position, during movement of said carriage away from said dispensing position to return said tripping troughs to their closed position.

* * * * *